US007845885B2

(12) United States Patent
Jaecklin

(10) Patent No.: US 7,845,885 B2
(45) Date of Patent: Dec. 7, 2010

(54) BUILDING ELEMENT FOR MAKING WALLS USING FILLING MATERIAL, PARTICULARLY EARTH OR THE LIKE

(75) Inventor: Felix Paul Jaecklin, Geissbergstrasse 46, CH-5408 Ennetbaden (CH)

(73) Assignee: Felix Paul Jaecklin, Ennetbaden (CH)

( * ) Notice: Subject to any disclaimer, the term of this patent is extended or adjusted under 35 U.S.C. 154(b) by 0 days.

(21) Appl. No.: 12/174,460

(22) Filed: Jul. 16, 2008

(65) Prior Publication Data

US 2008/0317557 A1 Dec. 25, 2008

(30) Foreign Application Priority Data

Apr. 21, 2006 (IT) ..... MO2006A0129

(51) Int. Cl.
*E02D 5/00* (2006.01)

(52) U.S. Cl. ..... 405/286; 405/284; 405/273; 52/608

(58) Field of Classification Search ..... 405/262, 405/273, 275, 284, 286; 52/600, 603, 604, 52/606, 608
See application file for complete search history.

(56) References Cited

U.S. PATENT DOCUMENTS 3,877,236 A 4/1975 O'Neill et al.
3,922,864 A 12/1975 Hilfiker
4,126,001 A 11/1978 Shimada et al.
4,293,245 A 10/1981 Jaecklin
4,372,091 A 2/1983 Brown et al.
4,384,810 A 5/1983 Neumann
4,741,140 A 5/1988 Nakamura
4,818,150 A 4/1989 Jaecklin
4,930,939 A 6/1990 Jaecklin
5,017,050 A 5/1991 Jaecklin
5,066,169 A 11/1991 Gavin et al.
5,131,791 A 7/1992 Kitziller
5,139,369 A 8/1992 Jaecklin
5,181,351 A 1/1993 Jaecklin
5,403,127 A 4/1995 Knudsen
5,419,092 A 5/1995 Jaecklin
5,468,098 A 11/1995 Babcock
5,474,405 A 12/1995 Anderson et al.

(Continued)

FOREIGN PATENT DOCUMENTS

DE 41 04 247 A1 8/1992

(Continued)

*Primary Examiner*—David J Bagnell
*Assistant Examiner*—Benjamin Fiorello
(74) *Attorney, Agent, or Firm*—Novak Druce + Quigg LLP

(57) ABSTRACT

A building element adapted to be assembled with a similar element to form a retaining wall, including a front panel section disposed at an angle relative to a first plane, having a rear planar surface lying in a second plane disposed at an angle relative to the first plane and inclined forwardly; a rear beam section spaced from the first panel section, having a height less than the height of the front panel section, a front planar surface lying in a third plane disposed at an angle relative to the first plane and inclined rearwardly and a rear planar surface lying in a plane disposed at an angle to the first plane and inclined forwardly; and at least one panel section interconnecting the front and rear panel sections.

20 Claims, 7 Drawing Sheets

U.S. PATENT DOCUMENTS

| | | | | | |
|---|---|---|---|---|---|
| 5,484,234 | A | | 1/1996 | Worden | |
| 5,564,865 | A | | 10/1996 | Jansson | |
| 5,567,089 | A | * | 10/1996 | Akamine | 405/285 |
| 5,620,283 | A | | 4/1997 | Walter | |
| 5,658,098 | A | | 8/1997 | Woolbright | |
| 5,688,078 | A | | 11/1997 | Hammer | |
| 5,836,129 | A | | 11/1998 | Jaecklin | |
| 6,341,922 | B1 | | 1/2002 | Jaecklin | |
| 6,505,999 | B1 | | 1/2003 | Lothspeich | |
| 6,539,684 | B1 | | 4/2003 | Graham | |
| 6,565,289 | B2 | | 5/2003 | Khamis | |
| 6,675,547 | B1 | | 1/2004 | Golcheh | |
| 6,685,400 | B1 | | 2/2004 | Ruel et al. | |
| 6,821,058 | B1 | | 11/2004 | Dawson | |
| 7,118,309 | B2 | | 10/2006 | Jaecklin | |
| 2004/0074193 | A1 | * | 4/2004 | Jaeckin | 52/606 |

FOREIGN PATENT DOCUMENTS

| | | | |
|---|---|---|---|
| DE | 100 49 290 | A1 | 4/2002 |
| DE | 102 39 533 | A1 | 10/2004 |
| FR | 2 680 195 | | 2/1993 |

* cited by examiner

Fig. 8
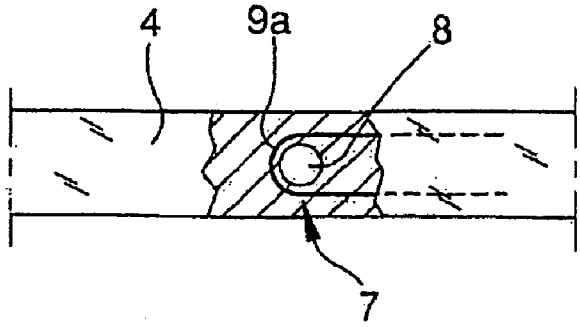
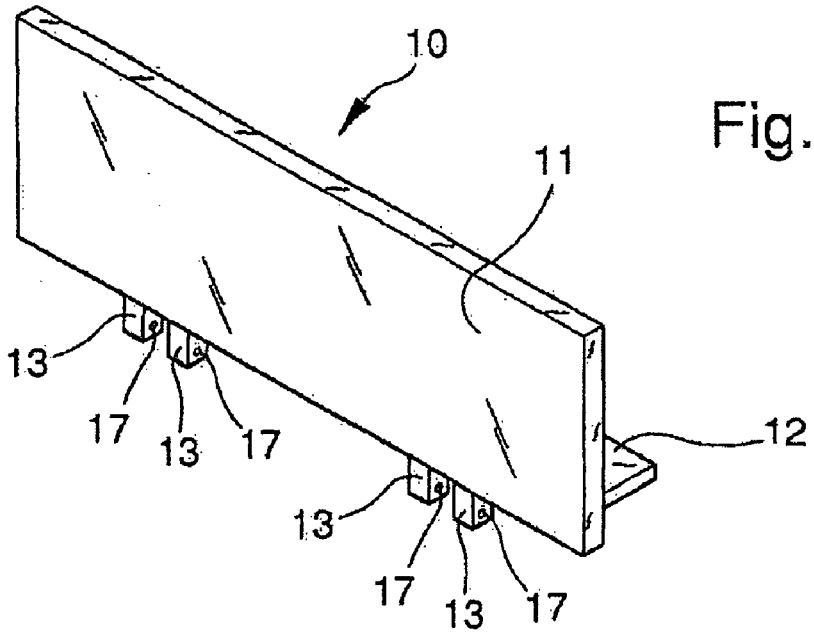
Fig. 9
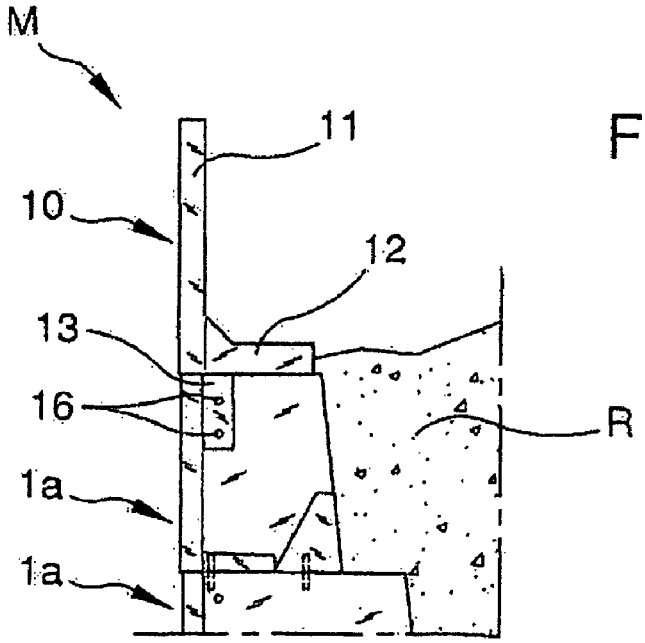
Fig. 10

Fig. 13
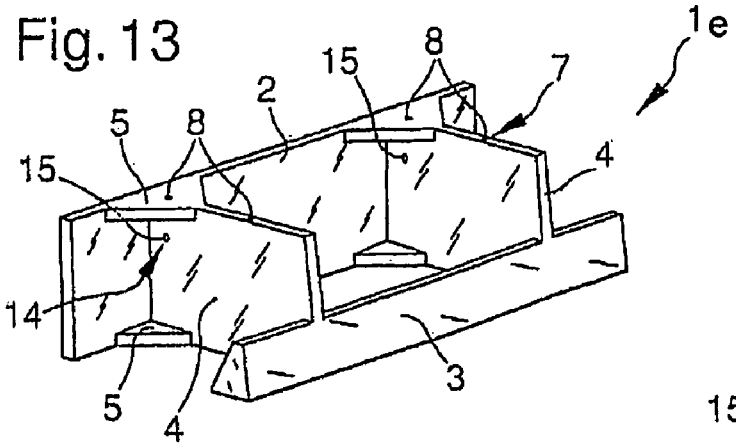
Fig. 14
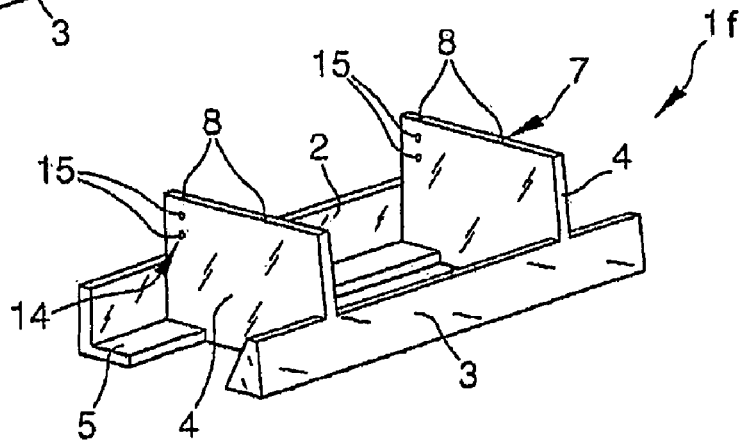
Fig. 15
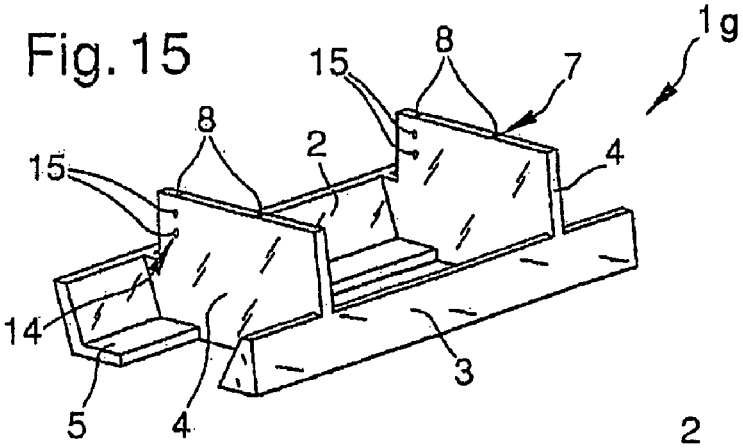
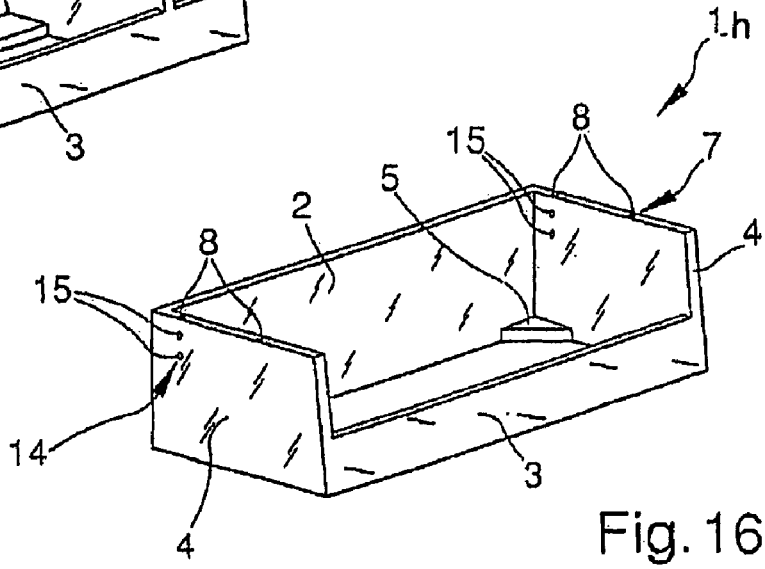
Fig. 16

BUILDING ELEMENT FOR MAKING WALLS USING FILLING MATERIAL, PARTICULARLY EARTH OR THE LIKE

CROSS-REFERENCE TO RELATED APPLICATION

This application is a continuation of International Application No. PCT/IB2007001039 filed 20 Apr. 2007 pursuant to 37 C.F.R. §1.78(d)(1)(iv).

This invention refers to a building element for making walls using filling material, particularly earth or the like.

BACKGROUND OF THE INVENTION

For making particular masonry works such as, for example, walls for retaining slopes and gradients at the side of roads, motorways, railways or the like, or the walls for creating drops between different urban levels, the use is known of different types of prefabricated building elements.

Such elements usually consist of beamed structures of considerable size made using concrete castings which, during wall building, are placed one at the top of the other and are then filled with filling material such as earth, sand, gravel, etc. The resulting wall is very stable and strong but can be further enhanced in this sense by using particular retention systems that permit joining the building elements the one to the other, or fastening these to the filling material and/or directly to a slope to be retained.

A first type of building elements consists in the association of a pair of longitudinal beams, substantially horizontal, with a pair of cross beams, which join together the longitudinal beams and define the supporting bases of the building element, permitting this to be rested on the ground or on another building element. In assembly configuration, the building elements are positioned so that the longitudinal beams are arranged parallel to the plane position of the wall to be built, with one of them facing outwards, while the other is arranged on the inner side of the wall.

The longitudinal beams are fitted on the top part of the cross beams and consequently, once the building elements have been installed, the filling material emerges on the outside between the cross beams and the outer longitudinal beam. In this first type of building elements then the filling material can act as fertile soil for growing plants such as grass, flowers or the like.

In a second type of building elements, on the other hand, the beamed structures have a side closed by a substantially vertical panel, from the inner face of which two cross beams extend which at the opposite end are connected together by a horizontal beam parallel with the panel.

The horizontal beam is arranged at the top of the cross beams, approximately at the same height as the top edge of the panel.

In assembly configuration the building elements are positioned with the horizontal beams on the inner side of the wall and the panels turned outwards and adjacent to one another; the resulting wall thus shows a substantially continuous outer surface from which the filling material does not come to the surface.

These building elements, though particularly strong, are susceptible to further upgrading aimed at making the production process easier and making them more practical to use during wall building.

In this respect in fact, it should be remembered that the shape of the known building elements results in their usually being formed inside voluminous shaped forms closed at the bottom, which are filled with fresh concrete and from which the element is removed by lifting once the cement has achieved a sufficient degree of strength and rigidity.

Before being able to lift building elements of such shapes and dimensions however, to avoid breakages, cracks or distortions the cement must solidify completely inside the form and this requires a particularly long time; the equipment for forming the traditional building elements therefore remains in use for a long time and permits making a limited number of elements each day, generally slowing down the production process and resulting in particularly high production costs.

It must also be emphasised that during the building of the wall, the filling material for covering the building elements must be compacted every time the elements are arranged the one on the other.

The compacting of the filling material is usually done by means of a compacting unit that pushes the filling material inside the beamed structures, pressing this down; this operation however is usually rather complicated because the compacting unit must be introduced from above between the beams and the panel, if provided, of the building elements, and the use is therefore necessary of a lift/excavator to raise the compacting unit above the beamed structure.

The main aim of the present invention is to achieve the aforementioned upgrading by providing a building element for building walls filled with filling material, particularly earth or the like, that can be manufactured in a practical and easy way, quickly and with relatively low production costs.

Another object of the present invention is to simplify the building of the wall, in particular making easier the assembly operations of one building element on the other and the covering operation with filling material.

SUMMARY OF THE INVENTION

The aforementioned objects are all achieved by the present building element for making walls using filling material, particularly earth or the like, comprising at least one structure provided with at least one front panel, at least one longitudinal beam substantially horizontal and parallel to said panel and at least one cross arm for connecting said panel with said longitudinal beam, in installation position said panel being turned towards the outer face of a wall filled with filling material and said longitudinal beam being arranged inside the wall itself; characterized in that said longitudinal beam is associated with said cross arm close to the supporting base of said structure.

BRIEF DESCRIPTION OF THE DRAWINGS

Further characteristics and advantages of this invention will appear even more evident from the detailed description of several preferred but not exclusive embodiments of a building element for making walls using filling material, particularly earth or the like, illustrated indicatively by way of non limiting example, in the attached drawings wherein:

the FIG. 1 is a perspective view of a first embodiment of the building element according to the invention;

Figure 1:
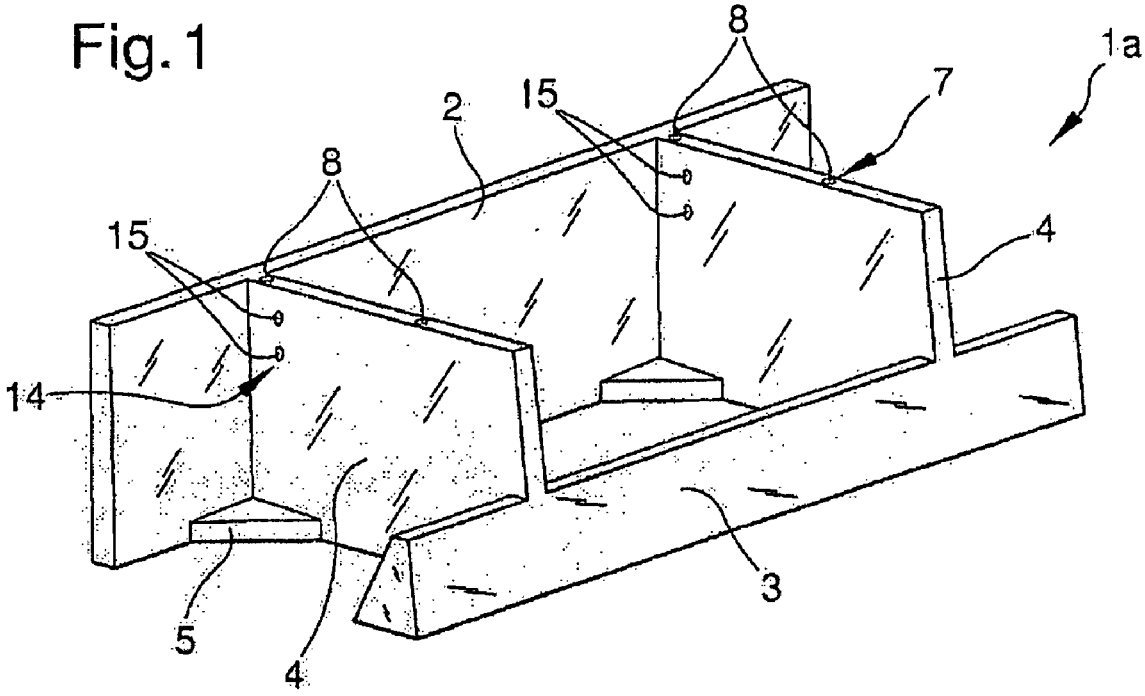
Figure 2:
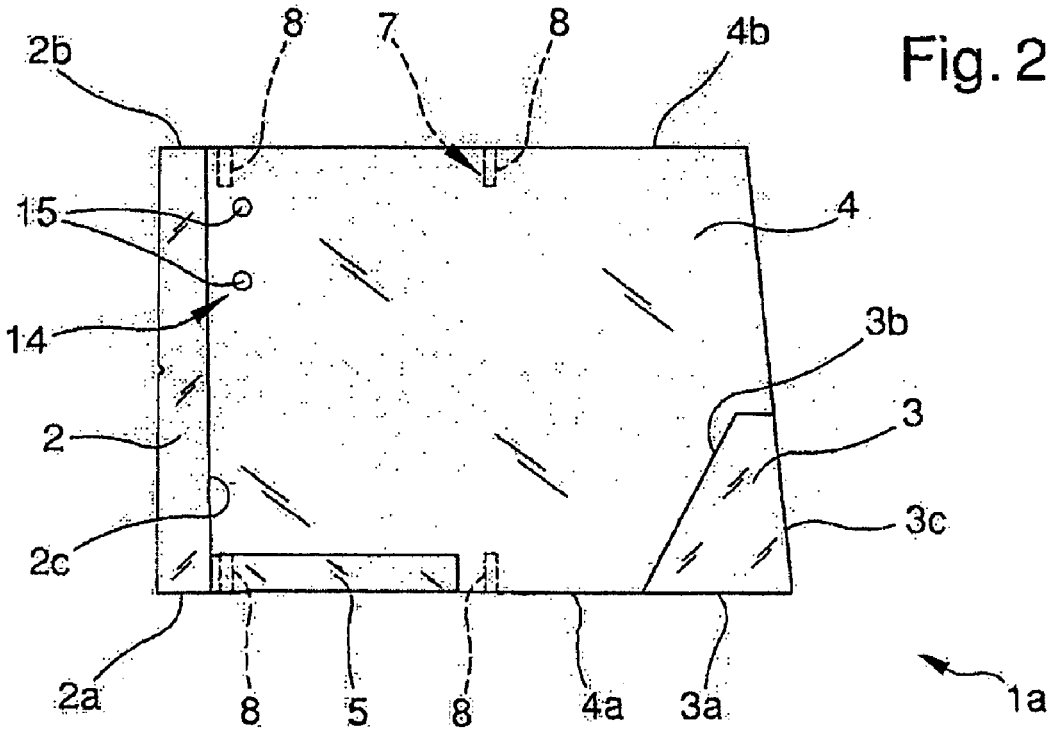
Figure 3:
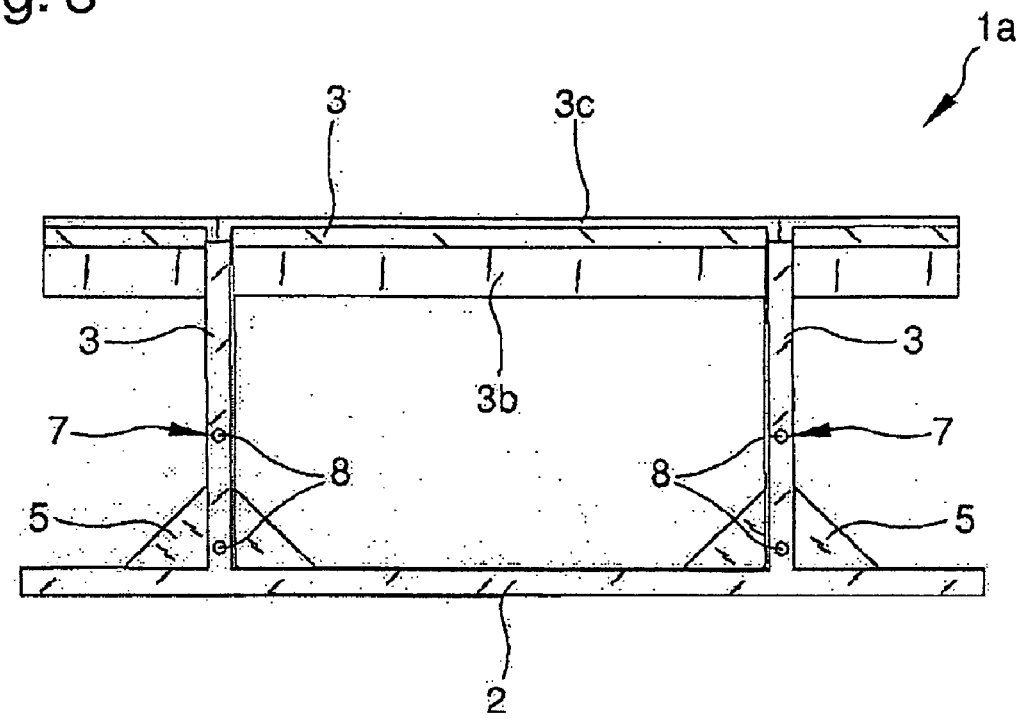
Figure 4:
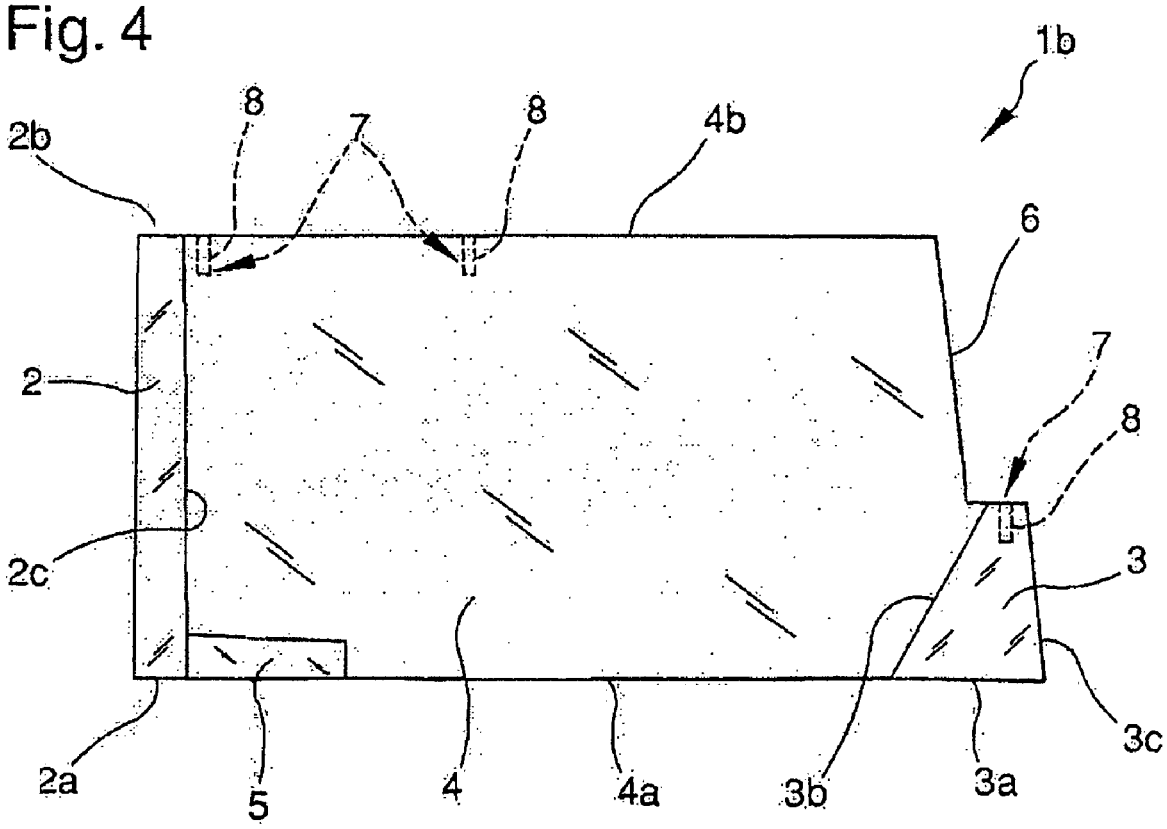
Figure 5:
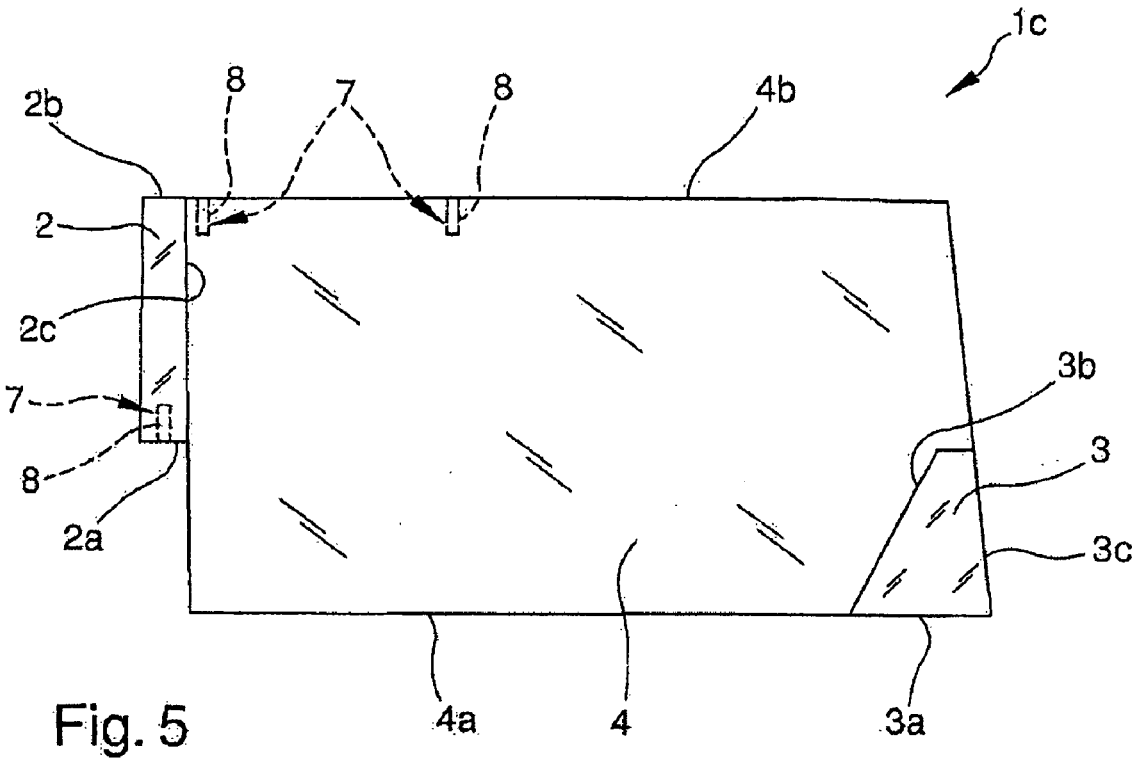
Figure 6:
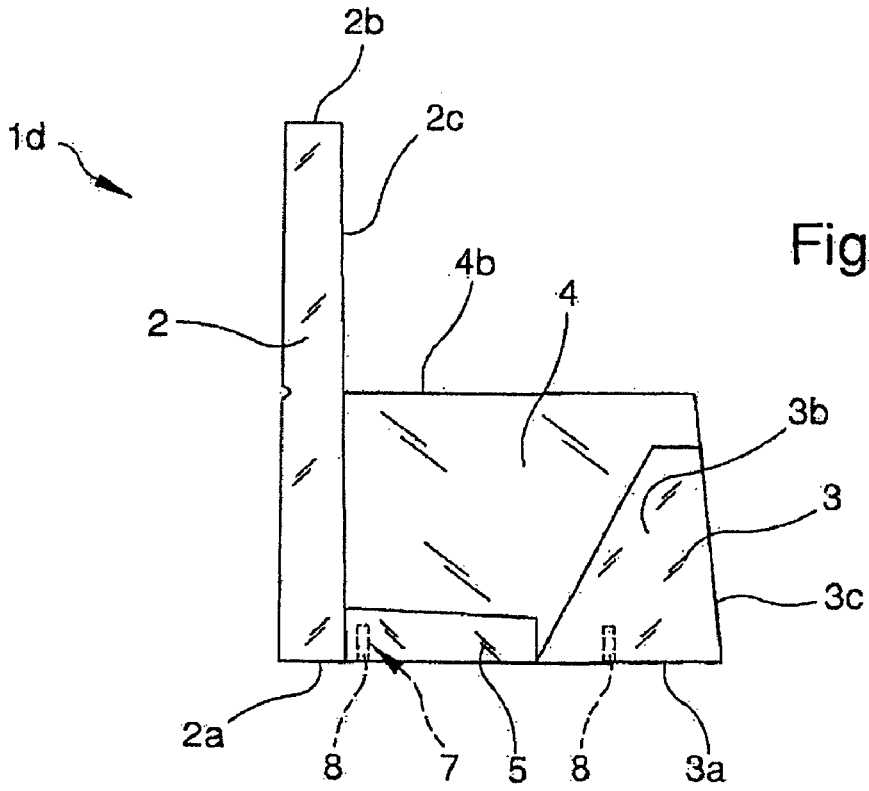
Figure 7:
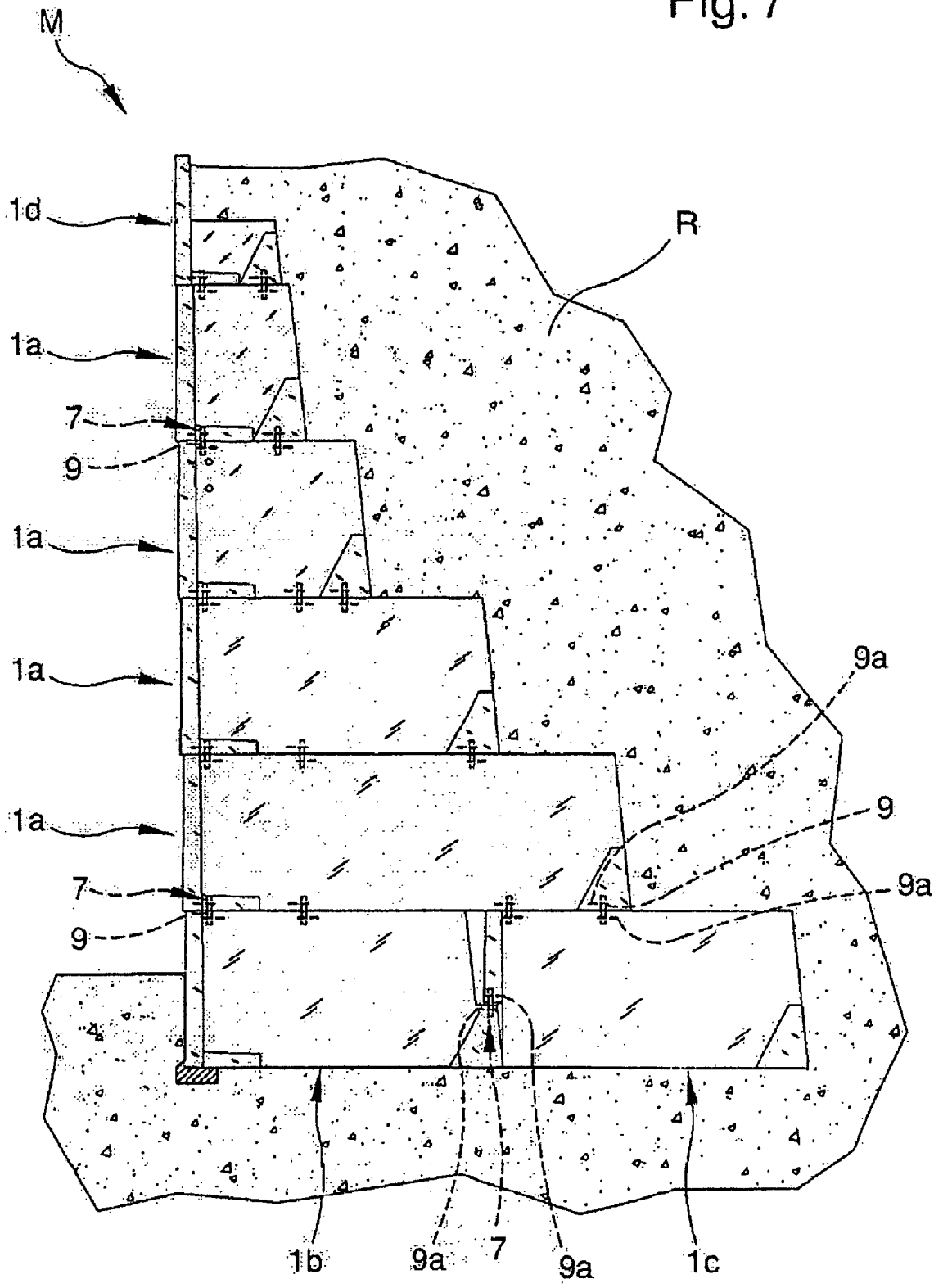
Figure 11:
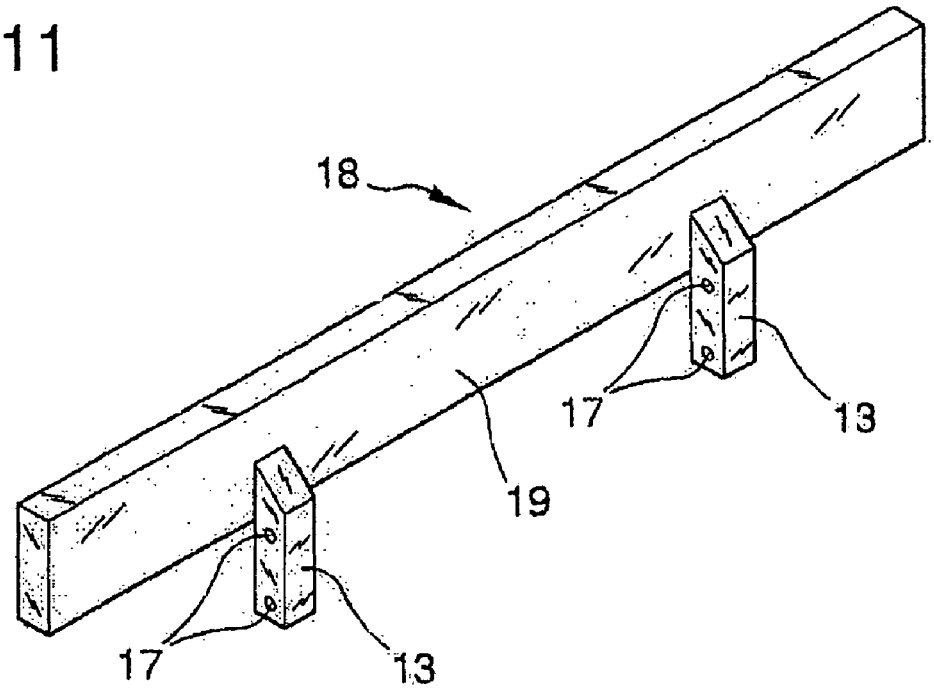
Figure 12:
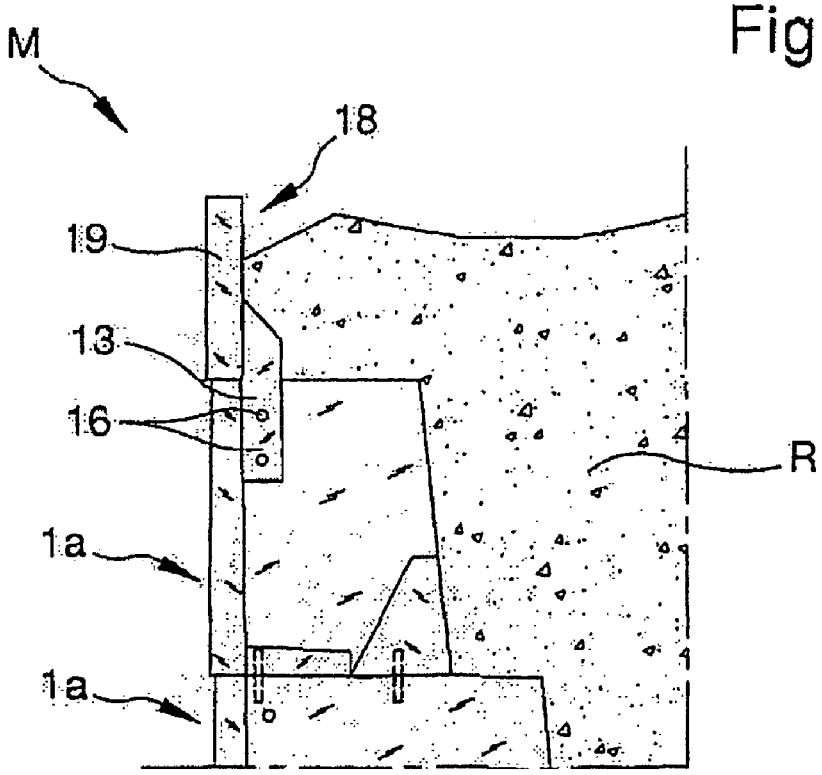

the FIG. 2 is a side view of the building element of FIG. 1;

the FIG. 3 is a plan view of the building element of FIG. 1;

the FIG. 4 is a side view of a second embodiment of the building element according to the invention;

the FIG. 5 is a side view of a third embodiment of the building element according to the invention;

the FIG. 6 is a side view of a fourth embodiment of the building element according to the invention;

the FIG. 7 is a transversal view of a wall made with the building elements according to the invention;

the FIG. 8 is a plan view, partially in section, of the means for fastening one building element to another;

the FIG. 9 is a perspective view of a parapet element according to the invention;

the FIG. 10 is a transversal, schematic and partial view of a wall built with the building elements and the parapet elements according to the invention;

the FIG. 11 is a perspective view of a retaining-edge element according to the invention;

the FIG. 12 is a transversal view of a wall made with the building elements and the retaining-edge elements according to the invention;

the FIG. 13 is a perspective view of a fifth embodiment of the building element according to the invention;

the FIG. 14 is a perspective view of a sixth embodiment of the building element according to the invention;

the FIG. 15 is a perspective view of a seventh embodiment of the building element according to the invention;

the FIG. 16 is a perspective view of a eighth embodiment of the building element according to the invention.

DETAILED DESCRIPTION OF THE PREFERRED EMBODIMENTS OF THE INVENTION

With particular reference to such figures, by 1 is globally indicated a building element for making walls using filling material, particularly earth or the like.

The building element 1 consists of a concrete structure provided with a front panel 2, substantially rectangular, of a longitudinal beam 3 horizontal and parallel with the panel 2, and of a pair of cross arms 4 for connecting the panel 2 to the longitudinal beam 3.

The cross arms 4, in detail, extend parallel to one another along a direction at right angles to the panel 2 and to the beam 3.

The assembly of different building elements 1 permits building a wall M filled with filling material R, in which the elements themselves are arranged in an installation position in which the panel 2 is turned towards the outer face of the wall M and the longitudinal beam 3 is arranged inside the wall itself and covered with the filling material R.

Different embodiments of the building element 1 are possible according to the invention which, for the sake of easier understanding, in the figures have been indicated with the reference numbers 1*a*, lb, 1 *c*, 1 *d*, 1 *e*, lf, l g, 1*h* to distinguish them the one from the other; a common feature of all these embodiments consists in the fact that the longitudinal beam 3 is associated with the cross arms 4 close to the supporting base of the structure 1.

The building element 1*a* according to a first embodiment of the invention is shown in the figures from 1 to 3, in which the panel 2 is substantially arranged vertically and is intended to be arranged parallel to the outer face of the wall M.

The lower edge 2*a* of the panel 2 and the lower edge 4*a* of the cross arms 4 are arranged close to the base of the structure 1; in particular, the lower edge 2*a* of the panel 2, the lower edge 3*a* of the longitudinal beam 3 and the lower edge 4*a* of the cross arms 4 represent the base of the building element 1 *a* for resting on the ground or on an underlying building element 1.

In this embodiment, the extension in height of the cross arms 4 is substantially the same as the extension in height of the panel 2; practically speaking, the lower edge 4*a* and the upper edge 4*b* of the arms 4 are substantially on the same plane as the lower edge 2*a* and the upper edge 2*b* of the panel 2 respectively.

Usefully, reinforcement means for reinforcing the connection between the panel 2 and the cross arms 4 are provided that, for example, are made up of a pair of brackets 5, triangular in shape, which are arranged horizontally near the base of the structure 1 and are placed in between the inner face 2*c* of the panel 2 and the side surfaces of the cross arms 4.

The cross arms 4 of the building element 1 *a* are associated both at the side and at the top with the longitudinal beam 3; practically speaking, these extend from the panel 2 as far as the longitudinal beam 3 and also protrude above this.

The panel 2, the longitudinal beam 3 and the cross arms 4 have a cross section tapered and enlarged at the lower portion; this particular characteristic, together with the fact that the longitudinal beam 3 is arranged at the base of the structure la, permits facilitating the operation of removal of the building element 1 a from the form during forming.

The building element 1*a*, in particular, can be conveniently formed inside shaped forms open at the bottom, which can be closed by simply resting on a horizontal surface.

Once arranged on the surface, the form is filled with fresh concrete and, after a short hardening stage, can be lifted leaving the building element 1 *a* on the horizontal surface to complete its drying; using the same form, therefore, numerous building elements can be made in a very short time.

It should be noted that the particular shape of the building element 1 *a* is without undercuts that could hinder the lifting of the form, and is such as to allow the forming of the building element 1 *a* directly in the position of use, which will be maintained until the building of the wall M without the need for any element tipping up operations.

The cross section of the longitudinal beam 3, in detail is shaped like a trapezium with the major and minor bases substantially horizontal.

The angle with respect to the vertical of the surface 3*b* of the longitudinal beam 3 turned towards the inside of the structure 1 *a* is substantially bigger than the angle with respect to the vertical of the surface 3*c* of the longitudinal beam 3 turned towards the outside of the structure 1 *a*.

During the building of the wall M, the building element 1 *a* is arranged in an installation position in which the panel 2 is arranged on the same plane as the outer surface of the wall M and represents the face of this.

The building element 1*b* according to a second embodiment of the invention is illustrated in cross section in the FIG. 4 and is completely similar to the building element la described previously, except for the fact that the cross arms 4 are associated laterally with the longitudinal beam 3 and do not also protrude above this.

Practically speaking, with respect to the first embodiment, in this second embodiment, the cross arms 4 have a shaped recess 6 obtained above the longitudinal beam 3 that permits coupling with a third embodiment of the invention, shown in cross section in FIG. 5.

In this third embodiment of the invention, the building element is generally indicated with the reference number 1*c* and is similar to the first embodiment except for the fact that it has a panel 2 with height extension substantially shorter than the height extension of the cross arms 4.

More in detail, the upper edges 4*b* of the cross arms 4 are substantially on the same plane as the upper edge 2*a* of the panel 2, while the lower edge 2*b* of the panel 2 is arranged higher up with respect to the lower edge 4*a* of the cross arms 4, which represent the supporting base of the structure lc together with the lower edge 3*a* of the longitudinal beam 3.

Moreover, the distance of the lower edge 2*a* of the panel 2 from the base of the structure 1*c* is substantially the same as the extension in height of the longitudinal beam 3 of an adjacent building element 1*b* according to the second embodiment.

Practically speaking, in installation position, the building element lb according to the second embodiment is arranged with the panel 2 arranged on the outer face of the wall M and, adjacent to it inside the wall M, is positioned the building element 1*c* according to the third embodiment, which has the relevant panel 2 arranged in the shaped recesses 6 above the longitudinal beam 3 of the adjacent building element 1*b*.

The building element 1*d* according to a fourth embodiment of the invention is shown in cross section in the FIG. 6 and is similar to the embodiment shown in the figures from 1 to 3, except for the fact that the height extension of the cross arms 4 is substantially less than the height extension of the panel 2.

More in detail, the lower edge 4*a* of the cross arms 4 and the lower edge 2*a* of the panel 2 are each on the same plane and define, together with the lower edge 3*a* of the longitudinal beam 3, the base of the building element 1*d*; the upper edge 4*b* of the cross arms 4, on the other hand, is arranged at a lower height with respect to the upper edge of the panel 2.

Such building element 1*d* is intended, during use, to be mounted on the top of the wall M, the upper portion of the panel 2 being used as a side retention wall for the filling material R.

The FIG. 7 shows a wall M made using building elements 1*a*, 1*b*, 1*c* and 1*d* of different dimensions.

The base of the wall M is fairly large and defined by the building elements 1*b* and 1*c* according to the second and third embodiment of the invention; above them are stacked the building elements 1*a* according to the first embodiment and at the top of the wall M are arranged the building elements 1*d* according to the fourth embodiment.

The quantity of building elements 1 *a* according to the first embodiment used to erect the wall M depends on the final height that this has to achieve.

Advantageously, each of the building elements 1*a*, 1*b*, 1*c* and 1*d* comprises fastening means 7 for fastening to an adjacent building element 1*a*, 1*b*, 1*c* and 1*d*.

Such fastening means comprise a plurality of holes 8 substantially vertical obtained in the lower edges 2*a*, 4*a* and upper edges 2*b*, 4*b* of the panels 2 and of the cross arms 4, in which corresponding lock pins 9 can be fitted.

The building of the wall M is therefore fairly simple being executed by the simple raising/lowering of one building element 1*a*, 1*b*, 1*c*, 1*d* on the other once the corresponding holes 8 have be aligned the one with the other.

To increase the resistance offered by the lock pins 9 to the side sliding forces between one building element 1*a*, 1*b*, 1*c*, 1*d* and another, the fastening means 7 also comprise a plurality of U-shaped reinforcement bodies 9*a*, of the bent bar type or the like, drowned inside the structure 1 around the holes 8 (FIG. 8).

As an alternative to the use of the building element 1*d* according to the fourth embodiment of the invention, at the top of the wall M, the positioning can be provided of a parapet element 10, shown in detail in the FIG. 9.

Such parapet element comprises a first slab 11, substantially rectangular and vertical, and a second slab 12, substantially horizontal and associated with the base side of the first slab 11.

In installation position (FIG. 10), the first slab 11 is arranged on the same plane as the outer face of the wall M and the second slab 12 is arranged above a building element 1 *a* at the top of the wall M.

With the lower surface of the second slab 12 is associated a plurality of vertical sections 13 which enable the parapet element 10 to be connected to the underlying building element 1*a*.

For this purpose, the building element la has connection means 14 for connecting to the parapet element 10, which comprise a pair of through openings 15 obtained substantially horizontal through each cross arm 4 and in which can be inserted an equal number of link pins 16 for connecting to the vertical sections 13.

On each cross arm 4 the through openings 15 are arranged substantially one above the other close to the upper edge 4*b* of the arm itself.

In detail, the vertical sections 13 of the parapet element 10 have a pair of through slots 17 substantially horizontal, which are obtained one above the other and in which the link pins 16 can be fitted.

The parapet element 10 shown in the FIG. 9 has two pairs of vertical sections 13, each pair being associable from opposite sides of a corresponding cross arm 4.

Other alternative embodiments of the present invention cannot however be ruled out in which, for example, the parapet element 10 has only two vertical sections 13, one for each of the cross arms 4.

Instead of the parapet element 10, the use can be provided of a retaining-edge element 18 made up of a vertical plate 19 which, in installation position, is arranged on the same plane as the outer face of the wall M over a building element 1*a*.

With a face of the vertical plate 19 is associated a plurality of vertical sections 13 completely similar to the vertical sections provided in the parapet element 10, which permit the connection of the retaining-edge element 18 to the through openings 15 of the building element 1*a*.

The retaining-edge element 18, in particular, has two vertical sections 13, each of which can be associated with one of the cross arms 4.

In the event of a more stable connection being required however, two pairs of vertical sections 13 can be provided, each pair being associable from opposite sides of each cross arm 4 in a way similar to the embodiment of the parapet element 10 shown in FIG. 9.

It should be noticed that in the embodiment of the retaining-edge element 18 shown in FIG. 11 the vertical plate 19 has a substantially rectangular shape, but alternative embodiments cannot be ruled out in which the shape is, for example, triangular.

FIG. 13 shows a building element 1 *e* according to a fifth embodiment of the invention, which is completely similar to the embodiment of the figures from 1 to 3 except for the fact that the reinforcement means for reinforcing the connection between the panel 2 and the cross arms 4 have a further pair of brackets 5, of triangular shape, which are arranged horizontally near the top of the structure 1 *e*.

FIG. 14, on the other hand, shows a building element 1*f* according to a sixth embodiment of the invention, in which the lower edges 4*a* of the cross arms 4 are substantially on the same plane as the lower edge 2*a* of the panel 2 and the upper edge 2*b* of the panel 2 is arranged at a lower height with respect to the upper edges 4*b* of the cross arms 4.

In this embodiment, moreover, the bracket 5 is shaped substantially rectangular and extends horizontally along the entire length of the panel 2.

The building element 1*g* according to a seventh embodiment is shown in FIG. 15 and is similar to the version represented in FIG. 14, except for the fact that the panel 2 is arranged substantially obliquely with respect to a vertical plane and extends from the base of the structure 1*g* substantially sloped outwards.

In all the embodiments of the previously described and illustrated building element 1*a*, 1*b*, 1*c*, 1*d*, 1*e*, 1*f*, 1*g*, the cross arms 4 are arranged substantially at a distance from the longitudinal ends of the panel 2 and of the longitudinal beam 3.

In particular, the distance of each cross arm 4 from the end closest to it is about double the distance between the two cross arms 4.

In the building element 1*h* according to the eighth embodiment shown in FIG. 16, on the other hand, the cross arms 4 are arranged right at the longitudinal ends of the panel 2 and of the longitudinal beam 3.

It has in fact been seen how the described invention achieves the proposed objects and in particular, the fact is reiterated that it permits using a fabrication method that is more functional and inexpensive compared to the traditional one.

Moreover, the particular solution of fitting a longitudinal beam arranged at the base of the building element, permits making the wall building operation considerably easier; covering the elements with filling material and compacting this inside the elements are in fact operations that can be performed quickly and simply from the rear of the wall without having to lift up a compacter as in the case of traditional building elements.

The invention thus conceived is susceptible of numerous modifications and variations, all of which falling within the scope of the inventive concept.

Furthermore, all the details may be replaced by other elements which are technically equivalent.

In practice, the materials used, as well as the contingent shapes and dimensions, may be any according to requirements without because of this moving outside the protection scope of the following claims.

The invention claimed is:

1. A building element adapted to be assembled with a similar element to form a retaining wall, comprising:

a front panel section disposed at an angle relative to a first base plane, having a rear planar surface lying in a second plane disposed at an angle relative to said first plane and inclined forwardly from said base plane;

a rear beam section spaced from said first panel section, having a height less than the height of said front panel section, a front planar surface lying in a third plane disposed at an angle relative to said first base plane and inclined rearwardly from said base plane, a rear planar surface lying in a fourth plane disposed at an angle relative to said first base plane and inclined forwardly relative so said base plane and a bottom surface disposed one of adjacent and in said first base plane; and at least one panel section interconnecting said front panel and rear beam sections.

2. A building element according to claim 1 wherein the angles of said inclined planar surfaces relative to said first plane are such where upon the placement of a form for casting said element on a support surface coinciding with said first plane, pouring a casting material into said form to form said element and allowing said material to partially set, said casting form may be removed from said cast material by displacing it from said support surface.

3. A building element according to claim 1 wherein bottom edges of at least said rear beam and interconnecting sections lie in said first plane.

4. A building element according to claim 1 including at least one bracket section interconnecting said front panel section and said interconnecting panel section, having a surface disposed in said first plane.

5. A building element according to claim 1 wherein a rear edge of said interconnecting section lies in said fourth plane.

6. A building element according to claim 1 wherein said element is formed as an integral structure of cast concrete.

7. A building element according to claim 1 including means for connecting said element to another element disposed in one of stacked, side-by-side and tandem relations.

8. A building element according to claim 1 wherein said rear beam section has a trapezoidal cross-sectional configuration.

9. A building element according to claim 1 including a pair of said interconnecting sections.

10. A building element according to claim 1 wherein a bottom edge of said front panel section is spaced from said first plane, and bottom edges of said interconnecting and rear beam sections lie in said first plane.

11. A building element according to claim 1 wherein the spacing between said first plane and an upper edge of said front panel section is less than the spacing between said first plane and said interconnecting panel section.

12. A building element according to claim 1 wherein the spacing between said first plane and an upper edge of said front panel section is greater than the spacing between first plane and said interconnecting panel section.

13. A building element according to claim 1 wherein the spacing between said first plane and an upper edge of said rear beam section is less than the spacing between said first plane and an upper edge of said interconnecting panel section.

14. A building element according to claim 1 wherein a rear edge of said interconnecting panel section lies in a fifth plane disposed at an angle relative to said first plane, forwardly of said fourth plane, and inclined forwardly.

15. A building element according to claim 1 wherein at least one of said sections is provided with at least one pin hole registrable with a pin hole of another building element for receiving a pin in registered pin holes to align and connect said building elements together.

16. A retaining wall comprising;

at least two building elements disposed in stacked relation, each of said elements including a front panel section disposed at an angle relative to a first base plane, having a rear planar surface lying in a second plane disposed at an angle relative to said first plane and inclined forwardly from said base plane; a rear beam section spaced from said first panel section, having a height less than the height of said front panel section, a front planar surface lying in a third plane disposed at an angle relative to said first plane and inclined rearwardly from said base plane, a rear planar surface lying in a fourth plane disposed at an angle relative to said first base plane and inclined forwardly relative to said base plane and a bottom surface disposed one of adjacent and in said first base plane; and at least one panel section interconnecting said front panel and rear beam section; and a fill material disposed in each of said elements.

17. A retaining wall according to claim 16 including means for interconnecting said elements.

18. A retaining wall according to claim 17 wherein said interconnecting means includes at least one set of cooperating openings in said elements and a pin received in said openings.

19. A retaining wall according to claim 16 wherein said front panel sections of said elements are substantially vertically aligned.

20. A retaining wall according to claim 16 including at least one element constructed similar to said first mentioned element, disposed in tandem relation to at least one of said first mentioned elements.

* * * * *

UNITED STATES PATENT AND TRADEMARK OFFICE

CERTIFICATE OF CORRECTION

PATENT NO. : 7,845,885 B2
APPLICATION NO. : 12/174460
DATED : December 7, 2010
INVENTOR(S) : Felix Paul Jaecklin It is certified that error appears in the above-identified patent and that said Letters Patent is hereby corrected as shown below:

Title Page; item (73);

On the face of the patent: the Assignee should read, "Geotech Lizenz A.G., Lugano-Castagnola (CH)" instead of the inventors name. The properly recorded assignment is on record with the PTO at Reel 021248 and Frame 0014.

Signed and Sealed this
Nineteenth Day of July, 2011

David J. Kappos

David J. Kappos
*Director of the United States Patent and Trademark Office*